US007237982B2

(12) United States Patent
Crea

(10) Patent No.: US 7,237,982 B2
(45) Date of Patent: Jul. 3, 2007

(54) AGRICULTURAL IMPLEMENT FOR INSTALLING AN IRRIGATION SYSTEM

(76) Inventor: Brian J. Crea, 111 Hampstead Village, Hampstead, NC (US) 28443

( * ) Notice: Subject to any disclaimer, the term of this patent is extended or adjusted under 35 U.S.C. 154(b) by 51 days.

(21) Appl. No.: 11/165,308

(22) Filed: Jun. 23, 2005

(65) Prior Publication Data

US 2006/0291959 A1 Dec. 28, 2006

(51) Int. Cl.
*E02B 11/02* (2006.01)

(52) U.S. Cl. ..... 405/179; 405/180

(58) Field of Classification Search ..... 405/159, 405/161, 164, 174, 176, 179, 180, 184; 111/200; 37/142.5, 368, 375

See application file for complete search history.

(56) References Cited

U.S. PATENT DOCUMENTS

| | | | | | |
|---|---|---|---|---|---|
| 873,260 | A | * | 12/1907 | Noll | 37/375 |
| 880,686 | A | * | 3/1908 | Mumford | 171/126 |
| 2,763,991 | A | | 9/1956 | Kennon | |
| 2,909,002 | A | | 10/1959 | Hendry | |
| 3,307,360 | A | | 3/1967 | Bailly | |
| 3,309,875 | A | | 3/1967 | Niederwemmer | |
| 3,332,249 | A | | 7/1967 | Idoine | |
| 3,408,818 | A | | 11/1968 | Hemphill | |
| 3,479,825 | A | | 11/1969 | Hellstrom | |
| 3,516,182 | A | | 6/1970 | Wykert | |
| 3,585,804 | A | | 6/1971 | Sramek | |
| 3,618,329 | A | | 11/1971 | Hanson | |
| 3,980,029 | A | * | 9/1976 | Huggett | 111/200 |
| 4,098,089 | A | * | 7/1978 | Zaslavsky et al. | 405/174 |
| 4,117,685 | A | | 10/1978 | Skaife | |
| 4,221,505 | A | | 9/1980 | Taylor-Smith | |
| 4,397,114 | A | | 8/1983 | Skaife | |
| 4,832,526 | A | | 5/1989 | Funkhouser, Jr. | |
| 4,920,694 | A | | 5/1990 | Higa | |
| 5,374,138 | A | | 12/1994 | Byles | |
| 5,492,434 | A | | 2/1996 | Adams et al. | |
| 5,938,372 | A | | 8/1999 | Lichfield | |
| 5,975,804 | A | * | 11/1999 | Bockman | 405/180 |

* cited by examiner

*Primary Examiner*—Sunil Singh
(74) *Attorney, Agent, or Firm*—MacCord Mason PLLC

(57) ABSTRACT

The present invention is an agricultural implement for installing an irrigation system. The implement is made up of a frame structure having front and rear ends including a hitch for attaching the frame structure to a tow vehicle. An earth-excavating chute is attached to the frame structure. The earth-excavating chute has a forward earth intake end and a rearward earth discharge end. The earth-excavating chute has a longitudinal axis that is downwardly inclined such that the earth discharge end is higher than the earth intake end. A spool support attached to the frame structure supports a spool of liner material beneath the chute and between the earth intake and discharge ends and transverse to the chute longitudinal axis to allow the liner material to unwind from the spool and be covered with discharged earth during an irrigation system installation operation.

20 Claims, 2 Drawing Sheets

AGRICULTURAL IMPLEMENT FOR INSTALLING AN IRRIGATION SYSTEM

BACKGROUND OF THE INVENTION (1) Field of the Invention

The present invention relates to agriculture and more particularly to an apparatus for installing an irrigation system.

(2) Description of the Prior Art

There are three main types of irrigation. The oldest and simplest form of irrigation is surface irrigation in which water is applied by surface flows and is applicable to farm lands having a variety of soil types. However, surface irrigation is relatively inefficient and is not appropriate for steep slopes or sandy soils. A higher efficiency irrigation type is over-head sprinkler irrigation with which an "artificial rainfall" is produced from an array of sprinkler heads mounted on an above ground framework of water pipes. While sprinkler irrigation is more efficient than surface irrigation, it is not sufficiently effective for loose arid soils. Drip irrigation including a buried moisture barrier is a more appropriate type of irrigation for loose arid soils. Drip irrigation delivers water at very low pressure through a soaker hose that has a plurality of sub-millimeter holes that allows water to drip near plant roots. The preferred moisture barrier is a moisture impermeable plastic sheet or film that is buried beneath the soaker hose.

Up to now, the main disadvantage of drip irrigation with a buried moisture barrier has been the high cost of installation. The high cost is due to the effort needed to cut a trench in the earth combined with the need to bury the moisture barrier. Past attempts of developing implements for installing drip irrigation systems with buried moisture barriers have been largely unsuccessful due to their mechanical complexity. One such attempt is disclosed in U.S. Pat. No. 3,309,875 to Niederwemmer. The Niedewemmer patent discloses a relatively complex mobile vehicle that includes a bucket chain, rotary digger, or the like for excavating a trench to bury a moisture barrier in the form of a plastic film. The mobile vehicle includes screens and conveyor belts for separating soils into various particle sizes before discharging the excavated soil overtop the plastic film and a soaker hose that are unspoolable from a plastic film carrying spool and a soaker hose carrying spool. Due to an undesirable level of mechanical complexity of the mobile irrigation installation systems such as disclosed by the Niederwemmer patent, a need remains for an irrigation installation implement that is less complex than prior art devices.

SUMMARY OF THE INVENTION

This need is addressed by the present invention, which is an agricultural implement for installing an irrigation system in arid soils.

The agricultural implement of the present invention comprises a frame structure having front and rear ends including a hitch for attaching the implement to a tow vehicle. In order for the implement to be releasibly attachable to standard agricultural tow vehicles (i.e., farm tractors), the hitch is attached to the front of the frame structure and is preferably of the three-point hitch type. The three-point hitch makes it possible for the tow vehicle to lower and raise the implement to and from the ground surface.

An earth-excavating chute is attached to the frame. The earth-excavating chute has a forward earth intake end and a rearward earth discharge end. The earth-excavating chute has a longitudinal axis and is downwardly inclined such that the earth discharge end is displaced above the earth intake end. A spool support means attached to the frame structure is adapted to support a spool of liner material beneath the chute between the earth intake and discharge ends. The spool of liner material is rotatably held by the spool support means so that the spool is transverse the chute longitudinal axis. This arrangement allows the liner material to unwind from the spool and be covered with discharged earth during an irrigation system installation operation. The spool of liner material is useable to line the inside of an excavated trench and is preferably a plastic film several mils thick and is useable to hold a water and nutrient solution inside an irrigation bed containing a soaker hose and excavated backfill.

The size of the trench formed by drawing the forward end of the earth-evacuating chute through the soil can vary considerably in both width and depth depending on the end use and soil conditions. Generally, however, the trench for most applications will be from about 12 to about 36 inches in width and from about 6 to about 24 inches in depth. The liner material should have a width at least equal to the width of the trench plus twice the depth of the trench, so that the floor and sidewalls of the trench are covered by the liner material. Preferably, the width of the liner should be at least about 110% greater than the width of the trench plus twice the depth of the trench so that the liner material projects upwardly from the sides of the trench to form a barrier.

The earth-excavating chute includes a floor plate having upper and lower surfaces and side edges with attached upwardly extending sidewalls having inner and outer surfaces. The plate and sidewalls are preferably made from steel with the floor plate being horizontal and the sidewalls being substantially vertical. It is also preferable for the floor plate upper surface and the sidewall inner surfaces to each have a friction coefficient that is within the range of 0.05 and 0.4. To achieve such low friction surfaces, the plate and sidewall surfaces can be coated or lined with polytetrafluoroethylene, which is commonly sold under the registered trademark Teflon. The low friction surfaces help prevent excavated earth from clogging the chute as the earth is forced along the chute during operation. Moreover, to further aid the excavation of earth, an earth cutting edge is located on the chute plate at the earth intake end. As a tow vehicle pulls the implement forward, the earth cutting edge slices into the earth lifting a section of earth up and onto the earth intake end of the chute. Continuous towing of the implement forces more earth onto the earth intake, which in turn pushes previously excavated earth through the chute and out of the earth discharge end where in drops downwardly onto the liner in the formed trench.

The agricultural implement of present invention also includes a means for supporting a spool of irrigation hose and is positioned to direct the hose to the rear of the frame structure during an irrigation system installation operation. A funnel or other hose guide is attached behind the spool to align the hose with the trench. The irrigation hose is preferably the soaker type having a plurality of sub-millimeter diameter holes along the length of the hose.

In another embodiment of the present invention, the implement includes an earth conveyor having an earth collecting end and an earth ejection end, wherein the conveyor earth collecting end is beneath the chute discharge end and the conveyor ejection end is located near the rear end of the frame structure. In this embodiment, the chute is shorter in length than the chute of the preferred embodiment. Preferably, a hydraulic motor that is driveable by a power take-off of the tow vehicle powers the earth conveyor. Since the earth conveyor is powered, the discharge of excavated earth is not reliant upon the forward speed of the tow vehicle. Therefore, the implement can be towed at slower speeds than the preferred embodiment having an earth chute only. Nevertheless, the chute only embodiment is preferred due to its lack of moving parts.

In operation, the implement of the present invention is attached to a tow vehicle by the three-point hitch. The tow vehicle is then operated to raise the implement from the ground surface and carry the implement to the start of an irrigation row. The implement is then lowered such that the cutting edge of the implement cuts into the earth surface. Next, the leading edge of the cover material is attached to the earth at the end of the irrigation row with a stake or weight. A free end of the irrigation hose is pulled from the hose spool and anchored to the earth near the end of the irrigation row. The tow vehicle is then driven forward at a speed sufficient for the implement cutting edge to cut a section of the earth and forcing it onto the excavating chute at the earth intake end. As the tow vehicle pulls the implement forward, the liner material unspools falling across the trench or channel left by the implement cutting edge. Continued forward motion of the tow vehicle forces a continuous stream of earth through the chute and out the chute earth discharge end. The discharged earth falls by force of gravity onto the liner material and back into the just-formed trench, forcing the liner into the trench and against the trench floor and sidewalls. At the same time, the soaker hose is pulled from its spool and is directed by the hose guide to the rear of the frame and onto the surface of the earth discharged over the liner material.

The embodiment having the conveyor works in much the same manner, except that the conveyor powered by the tow vehicle's power take-off carries the excavated earth. In this case, the implement cutting edge cuts a section of earth and forces onto the excavator chute as before, but instead of discharging the earth onto the liner material, the excavated earth is discharged to the conveyor earth-collecting end. From here the excavated earth is carried by the conveyor to the conveyor earth ejecting end, where the excavated earth is dropped onto the liner material lining the excavated trench. The soaker hose and liner material is pulled from their respective spools as before by the forward motion of the tow vehicle.

The result of the operation of either embodiment is an irrigation bed having a moisture barrier lined trench backfilled with earth and an irrigation soaker hose. After installation, the soaker hose can be connected to a nutrient rich solution that hydroponically feeds any crops planted in the irrigation bed. Other objectives of the invention will become apparent to one skilled in the art upon reading the following detailed description of the invention, taken with the drawings.

DETAILED DESCRIPTION OF THE INVENTION

In the following description, terms such as horizontal, upright, vertical, above, below, beneath and the like, are used solely for the purpose of clarity in illustrating the invention, and should not be taken as words of limitation. The drawings are for the purpose of illustrating the invention, and are not intended to be to scale.

Figure 1:
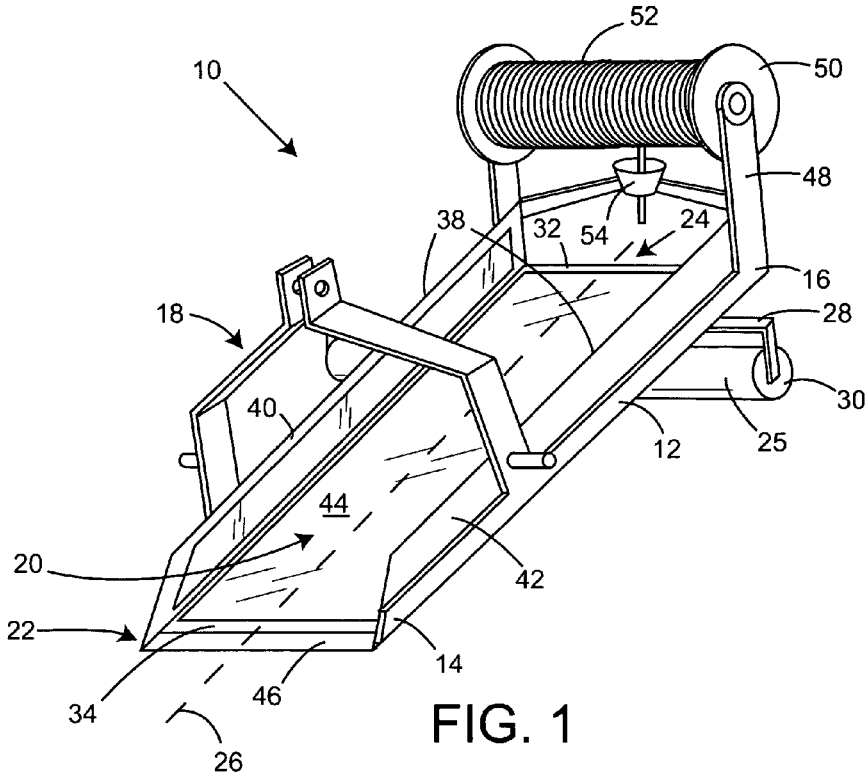
FIG. 1 is a perspective view of the preferred embodiment of the agricultural implement of the present invention.
Figure 2:
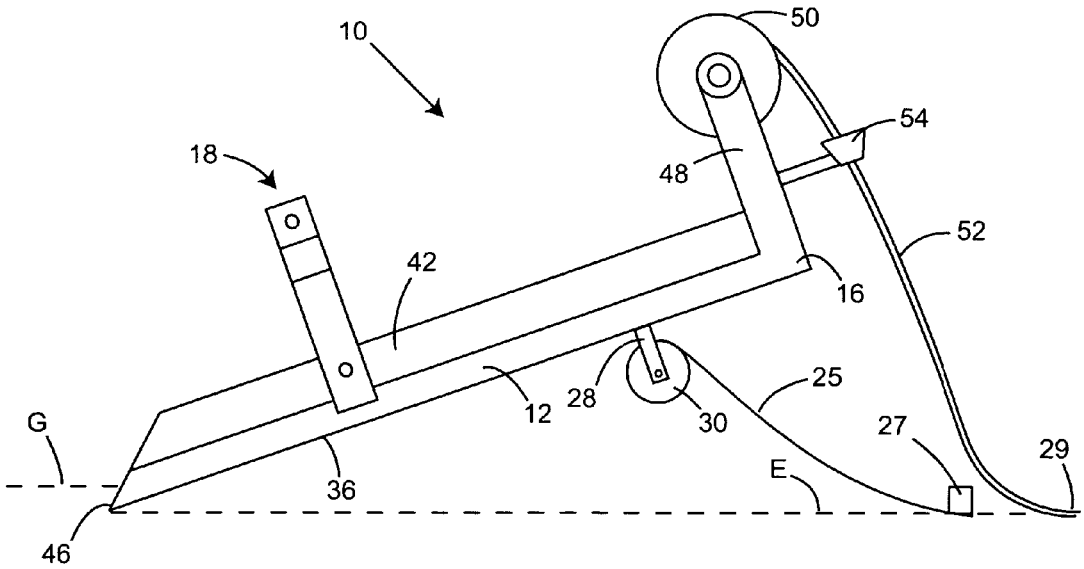
FIG. 2 is a side view of the preferred embodiment of the agricultural implement of the present invention.

FIGS. 1 and 2 show one embodiment of the agricultural implement for installing an irrigation system. An agricultural implement, generally 10, is comprised of a frame structure 12 having a front end 14 and rear end 16 including a three-point hitch 18 for attaching implement 10 to a tow vehicle.

An earth-excavating chute 20 is attached to frame 12. Earth-excavating chute 20 has a forward earth intake end 22 and a rearward earth discharge end 24. Earth-excavating chute 20 has a longitudinal axis 26 and is downwardly inclined such that earth discharge end 24 is displaced above earth intake end 22. A spool support means 28 attached to the frame structure is supporting a spool 30 of liner material 25 beneath chute 20 between earth intake end 22 and earth discharge end 24. Spool 30 is rotatably held by support means 28 so that spool 30 is transverse of chute longitudinal axis 26 to allow liner material 25 to unwind from spool 30 and be covered with discharge earth during an irrigation system installation operation.

Earth-excavating chute 20 is made up of a floor plate 32 having an upper surface 34 and a lower surface 36 along with side edges having attached upwardly extending sidewalls 38 each having an inner surface 40 and an outer surface 42. Plate 32 and sidewalls 38 are preferably made from steel. Plate upper surface 34 and sidewall inner surfaces 40 are at least partially covered with polytetraflouroethylene 44. Moreover, to further aid the excavation of earth, an earth cutting edge 46 is located on chute plate 32 at earth intake end 22.

Agricultural implement 10 also includes a second spool support means 48 for supporting a spool of irrigation hose 52 and is positioned to direct hose 52 from the rear of frame structure 12 during an irrigation system installation operation. A funnel 54 through which hose 52 is directed to prevent hose 52 from kinking is attached to the rear of the frame structure 12.

Figure 3:
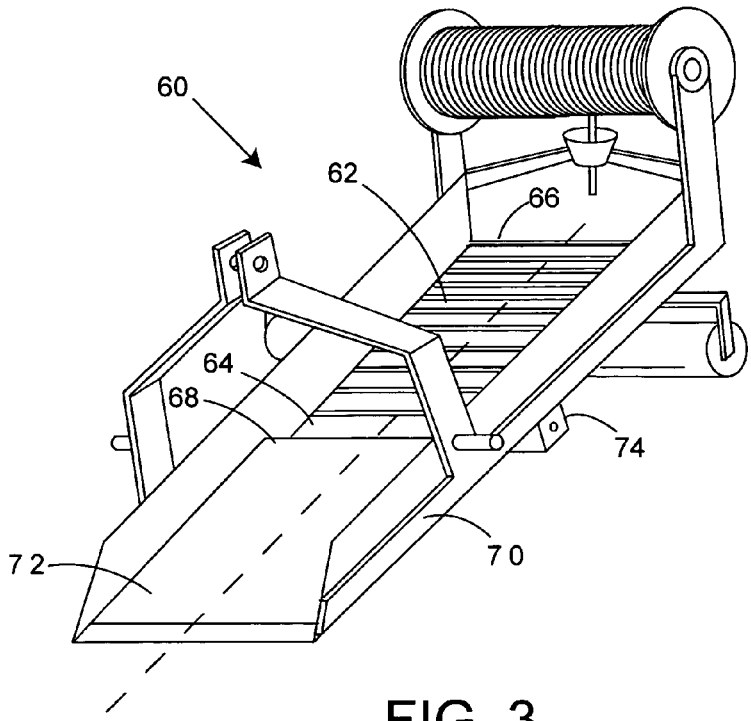
FIG. 3 is a perspective view of another embodiment of the agriculture implement of the present invention.
Figure 4:
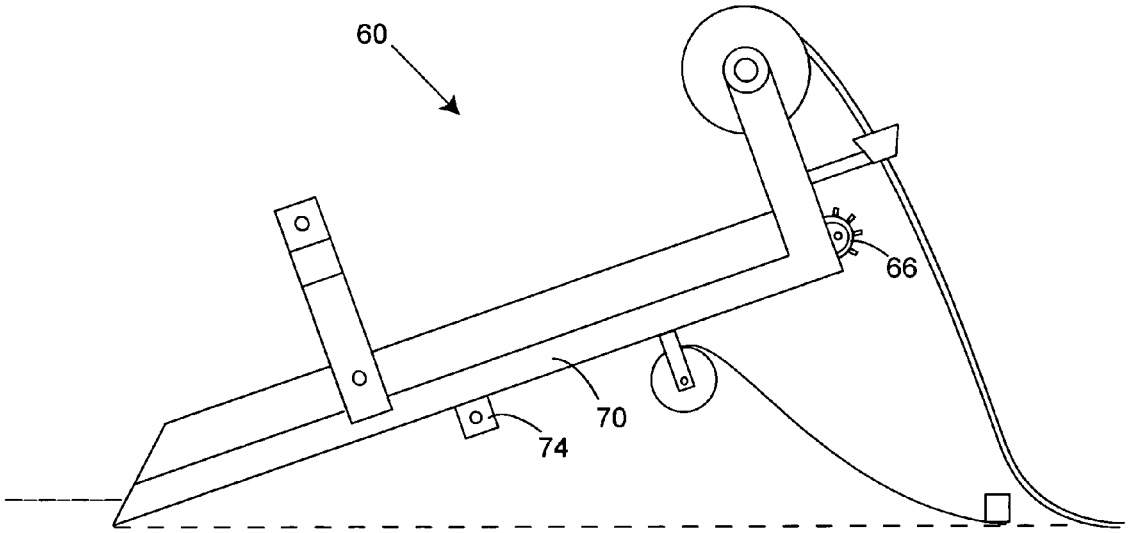
FIG. 4 is a side view of another embodiment of the agriculture implement of the present invention.

In another embodiment shown in FIGS. 3 and 4, an agricultural implement, generally 60 includes an earth conveyor 62 having an earth collecting end 64 and an earth ejection end 66, wherein conveyor earth collecting end 64 is located beneath a chute discharge end 68. Conveyor ejection end 66 is located near the rear end of frame structure 70. In this embodiment, an earth excavator chute 72 is shorter in length than earth excavator chute 20 of FIG. 1. Preferably, a hydraulic motor 74 that is driveable by a power take-off of the tow vehicle powers earth conveyor 62.

Turning back to FIGS. 1 and 2, in operation, implement 10 is attached to a tow vehicle (not shown) by the three-point hitch 18. The tow vehicle is then operated to raise implement 10 from the ground surface and carry the implement to the start of an irrigation row. The implement is then lowered such that implement cutting edge 46 cuts into the earth surface G. Next, a leading edge of the cover material 25 is attached to the earth at the end of the irrigation row with a stake and/or weight 27. A free end 29 of the irrigation hose 52 is pulled from hose spool 50 and anchored to the earth E near the end of the irrigation row. The tow vehicle is then driven forward at a speed sufficient for implement cutting edge 46 to cut a section of the earth and force it onto excavating chute 20 at earth intake end 22. As the tow vehicle pulls implement 10 forward, liner material 52 unspools falling into a trench or channel left by implement cutting edge 46. A continued forward motion of the tow vehicle forces a continuous stream of earth through chute 20 and out of chute discharge end 24. Discharged earth falls by force of gravity onto a section of liner material 25 lying in the trench. At the same time, soaker hose 52 is pulled from hose spool 50 and is directed by hose funnel 54 from the rear of frame structure 12 and onto the discharge earth lying onto a section of liner material 25.

Certain modifications and improvements will occur to those skilled in the art upon a reading of the foregoing description. It should be understood that all such modifications and improvements have been deleted for the sake of conciseness and readability but are properly within the scope of the following claims.

What is claimed is:

1. An agricultural implement for installing an irrigation system, said implement comprising:

a) a frame structure having front and rear ends including a hitch for attaching said frame structure to a tow vehicle;

b) an earth-excavating chute adapted to form a trench having a given width and a given depth attached to said frame, said earth-excavating chute having a forward earth intake end and a rearward earth discharge end, wherein said earth-excavating chute has a longitudinal axis and is downwardly inclined such that said earth discharge end is higher than said earth intake end;

c) a first spool support means attached to said frame structure to support a spool of moisture barrier liner material beneath said chute between said earth intake and discharge ends and transverse said chute longitudinal axis to allow the liner material to unwind from the spool and be covered with discharge earth during an irrigation system installation operation; and d) a spool of moisture barrier liner material supported on said first spool support means, said moisture barrier liner material having a width at least equal to the width of said trench plus twice the depth of said trench.

2. The agricultural implement of claim 1, further including a second spool support means adapted to support a spool of soaker hose positioned to direct said hose to the rear of said frame during an irrigation system installation operation, and a spool of soaker hose supported on said second spool support means.

3. The agricultural implement of claim 2, further including a guide to align said hose with said trench.

4. The agricultural implement of claim 1, wherein said earth-excavating chute comprises a floor plate having upper and lower surfaces along with side edges having attached upwardly extending sidewalls with inner and outer surfaces.

5. The agricultural implement of claim 4, wherein said floor plate upper surface has a friction coefficient that is within the range of 0.05 and 0.4.

6. The agricultural implement of claim 4, wherein said sidewall inner surfaces each have a friction coefficient between the range of 0.05 and 0.4.

7. The agricultural implement of claim 1, wherein said hitch is a three-point hitch for hitching said agricultural implement to an agricultural type tractor.

8. The agricultural implement of claim 1, wherein said hitch is attached to the front of said frame.

9. The agricultural implement of claim 1, further including an earth cutting edge located on said chute plate at said earth intake end.

10. An agricultural implement for installing an irrigation system, said implement comprising:

a) a frame structure having front and rear ends including a hitch for attaching said frame structure to a tow vehicle;

b) an earth-excavating chute adapted to form a trench having a given width and a given depth attached to said frame, said earth-excavating chute having a forward earth intake end and a rearward earth discharge end, wherein said earth-excavating chute has a longitudinal axis and is downwardly inclined such that said earth discharge end is higher than said earth intake end;

c) an earth conveyor having an earth collecting end and an earth ejection end, wherein said conveyor earth collecting end is beneath said chute discharge end and said conveyor ejection end is located near the rear end of said frame;

d) a first spool support means attached to said frame structure for supporting a spool of moisture barrier liner material beneath said chute between said earth intake and ejection ends and transverse to said chute longitudinal axis to allow the liner material to unwind from the spool and be covered with discharged earth during an irrigation system installation operation; and e) a spool of moisture barrier liner material supported on said first spool support means, said moisture barrier liner material having a width at least equal to the width of said trench plus twice the depth of said trench; and f) a second spool means adapted to support a spool of soaker hose positioned to direct said hose to the rear of said frame during an irrigation system installation operation, and a spool of soaker hose supported on said second spool means.

11. The agricultural implement of claim 10, wherein said earth conveyor is powered by a hydraulic motor driveable by a tow vehicle power take-off.

12. The agricultural implement of claim 10, further including a means for supporting a spool of irrigation hose positioned to direct said hose to the rear of said frame during an irrigation system installation operation.

13. The agricultural implement of claim 10, further including an earth cutting edge located on said chute plate at said earth intake end.

14. The agricultural implement of claim 10, wherein said hitch is a three-point hitch for hitching said agricultural implement to an agricultural type tractor.

15. The agricultural implement of claim 10, wherein said hitch is attached to the front of said frame.

16. An agricultural implement for installing an irrigation system, said implement comprising:

a) a frame structure having front and rear ends including a hitch attached to said frame front end for attaching said frame structure to a tow vehicle;

b) an earth-excavating chute adapted to form a trench having a given width and a given depth attached to said frame, said earth-excavating chute having a floor plate with upper and lower surfaces along with side edges having attached upwardly extending sidewalls with inner and outer surfaces, said earth-excavating chute having a forward earth intake end and a rearward earth discharge end, wherein said earth-excavating chute has a longitudinal axis and is downwardly inclined such that said earth discharge end is displaced above said earth intake end;

c) a first spool support means attached to said frame structure for supporting a spool of liner material beneath said chute between said earth intake and discharge ends being transverse said chute longitudinal axis to allow the liner material to unwind from the spool and be covered with discharge earth during an irrigation system installation operation;

d) a spool of moisture barrier liner material supported on said first spool support means, said moisture barrier liner material having a width at least 110% greater than the width of said trench plus twice the depth of said trench; and e) a second spool means for supporting a spool of irrigation hose positioned to direct said hose to the rear of said frame during an irrigation system installation operation, and a spool of soaker hose supported on said second spool means.

17. The agricultural implement of claim 16, wherein said plate upper surface and said sidewall inner surfaces are coated with polytetraflouroethylene to present a low friction interface for excavated earth passing over said chute surfaces.

18. The agricultural implement of claim 16, wherein said hitch is a three-point hitch for hitching said agricultural implement to an agricultural type tractor.

19. The agricultural implement of claim 16, further including an earth cutting edge located on said chute plate at said earth intake end.

20. The agricultural implement of claim 16, further including a hose guide to align said hose with said trench.

* * * * *